United States Patent [19]

Munsey et al.

[11] Patent Number: 4,850,176

[45] Date of Patent: Jul. 25, 1989

[54] ACCESS FLOOR PANEL WITH PERIPHERAL TRIM

[75] Inventors: R. Jack Munsey, Caledonia; Gordon J. Cooper, Alto, Todd N. Rose, Kentwood, all of Mich.

[73] Assignee: C-Tec, Inc., Grand Rapids, Mich.

[21] Appl. No.: 138,337

[22] Filed: Dec. 28, 1987

[51] Int. Cl.[4] ..... E04C 2/38; E04C 2/34; E04F 19/02

[52] U.S. Cl. ..... 52/829; 52/716; 52/802; 52/821

[58] Field of Search ..... 52/802, 803, 804, 805, 52/810, 821, 822, 823, 126.6, 263, 785, 814, 815, 827, 828, 718, 717, 716, 826, 829, 830, 792, 795, 796, 801

[56] References Cited

U.S. PATENT DOCUMENTS

| | | | |
|---|---|---|---|
| 2,194,421 | 3/1940 | Saussure, Jr. | 52/717 |
| 2,205,363 | 6/1940 | Kral | 52/718 |
| 2,278,331 | 3/1942 | Meyercord . | |
| 2,605,157 | 7/1952 | Reitzel | 52/822 |
| 2,729,142 | 1/1956 | Beach, Jr. | 52/823 |
| 3,077,012 | 2/1963 | Speraw | 52/822 |
| 3,180,460 | 4/1965 | Liskey, Jr. . | |
| 3,236,018 | 2/1966 | Graham et al. . | |
| 3,396,501 | 8/1968 | Tate . | |
| 3,667,071 | 6/1972 | Hoch et al. | 52/716 |
| 3,728,832 | 4/1973 | Erck . | |
| 3,736,713 | 6/1973 | Flachbarth et al. . | |
| 3,759,005 | 9/1973 | Smith . | |
| 3,837,130 | 9/1974 | Hildebrandt et al. . | |
| 4,035,967 | 7/1977 | Harvey . | |
| 4,085,557 | 4/1978 | Tharp . | |
| 4,142,341 | 3/1979 | Mott . | |
| 4,267,679 | 5/1981 | Thompson | 52/805 |
| 4,279,109 | 7/1981 | Madl, Jr. . | |
| 4,286,410 | 9/1981 | Hahn . | |
| 4,295,319 | 10/1981 | Griffin . | |
| 4,319,520 | 3/1982 | Lanting et al. . | |
| 4,394,026 | 7/1983 | Kaiser et al. . | |
| 4,447,998 | 5/1984 | Griffin . | |
| 4,453,365 | 6/1984 | Gladden . | |
| 4,461,131 | 7/1984 | Pressell . | |
| 4,548,843 | 10/1985 | Kozuka et al. | 52/716 |
| 4,574,555 | 3/1986 | Cline . | |
| 4,594,831 | 6/1986 | Winyard . | |
| 4,606,156 | 8/1986 | Sweers et al. . | |
| 4,621,468 | 11/1986 | Likozar . | |
| 4,625,491 | 12/1986 | Gibson . | |

FOREIGN PATENT DOCUMENTS

| | | | |
|---|---|---|---|
| 858417 | 11/1940 | France | 52/823 |
| 1397939 | 3/1965 | France | 52/717 |
| 90081 | 10/1967 | France | 52/802 |
| 452163 | 12/1966 | Switzerland . | |
| 753807 | 8/1956 | United Kingdom | 52/716 |

OTHER PUBLICATIONS

C-Tec, Inc. brochure entitled "A New Horizon In Access Flooring", (1984).

*Primary Examiner*—Michael Safavi
*Attorney, Agent, or Firm*—Price, Heneveld, Cooper, DeWitt & Litton

[57] ABSTRACT

An access floor panel includes a generally rectangular pan having a bottom and sides. The pan includes peripheral flanges which define downwardly opening channels or grooves extending around the edge or periphery of the panel. A plurality of elongated, vinyl trim pieces are slidably positioned on the peripheral flanges and disposed within the downwardly opening channels. Each of the trim pieces includes a generally L-shaped slot dimensioned to receive the peripheral flange.

10 Claims, 1 Drawing Sheet

ACCESS FLOOR PANEL WITH PERIPHERAL TRIM

BACKGROUND OF THE INVENTION

The present invention relates to raised access floor systems and more particularly to an access floor panel with a vinyl peripheral trim.

Various forms of access floor systems are presently available. These systems provide a functional floor elevated above the structural floor of a building. The systems, for example, provide a means for easily installing and subsequently accessing power and communication cables required in computer installations. The systems are also used in a variety of environments permitting heating, cooling and ventilation equipment and distribution systems to be conveniently located and accessed beneath the floor.

Typically, an access floor system includes a plurality of rectangular floor panels supported at their four corners on pedestals resting on a structural floor. The panels may be of several different constructions. In one construction, a steel pan having integral sides and bottom is filled with a lightweight, high-strength concrete mix. The mix may be covered on its top surface with monolithic carpeting, carpet tiles, vinyl asbestos tiles, cnoductive vinyl or high-pressure plastic laminate. In another panel construction, top and bottom steel sheets are structurally bonded to a high density wood particle core. The sheets are welded to steel perimeter channels which form the sides of the pan of each access floor panel. The top steel sheet may be covered or finished with carpeting, conductive vinyl and vinyl asbestos tile surfaces or high-pressure plastic laminate. An example of a prior floor panel and access floor system may be found in commonly owned U.S. Pat. No. 4,606,156 entitled ACCESS FLOOR PANEL and issued on Aug. 19, 1986 to Sweers et al.

In many of the prior panels, peripheral trim is applied. The trim is generally included for aesthetic reasons. The trim may, for example, frame a carpet square and protect the carpet edge from unraveling. In addition, the trim pieces may eliminate gaps between the finish covering and the perimeter of the pan structure. Examples of peripheral -im may be found in U.S. Pat. No. 4,085,557 entitled RAISED ACCESS FLOOR SYSTEM and issued on Apr. 25, 1978 to Tharp and U.S. Pat. No. 4,295,319 entitled FLOOR PANEL and issued on Oct. 20, 1981 to Griffin. A need exists for a panel and panel edge trim which is easily assembled to the panel and held in a fixed locked position. The edges should be retained yet be relatively easily replaceable in the field.

SUMMARY OF THE INVENTION

In accordance with the present invention, a unique peripheral trim piece for an access floor panel is provided. Essentially, the trim piece is an elongated body having an outer surface, a generally flat inner surface, an upper surface and a slot opening through the inner surface. The slot is dimensioned to receive a correspondingly configured flange formed as part of the access floor panel. In the preferred form, the panel includes a generally rectangular pan having a bottom and sides. A peripheral flange extends around the upper edge of the sides of the pan. The flange and pan define a downwardly opening channel. The trim piece is assembled onto the pan in a direction parallel to the pan edge and retained by the flange.

DETAILED DESCRIPTION OF THE PREFERRED EMBODIMENT

Figure 1:
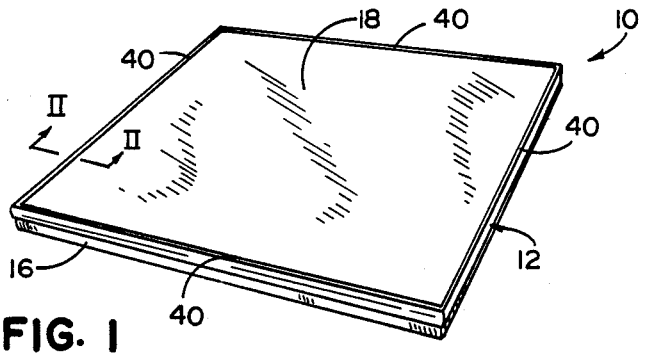
FIG. 1 is a perspective view of an access floor panel in accordance with the present invention.
Figure 2:
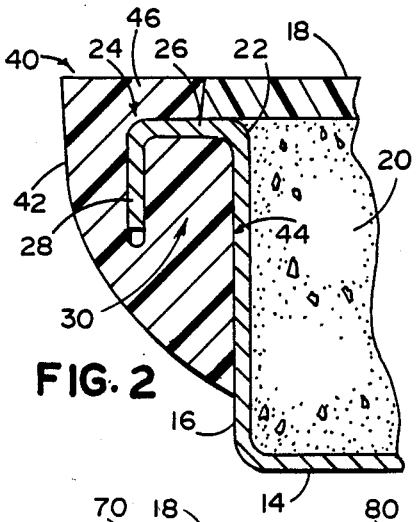
FIG. 2 is an enlarged, fragmentary, cross-sectional view taken generally along line II—II of FIG. 1.

An access floor panel in accordance with the present invention is illustrated in FIG. 1 and generally designated by the numeral 10. Panel 10 includes a pan 12. The pan has a bottom 14 and sidewalls 16 (FIG. 2). A top surface of the pan 12 may be covered or finished with a high pressure plastic laminate 18. In the alternative, the covering of the top of the panel may be carpeting, conductive vinyl, vinyl asbestos tile or other suitable materials. As illustrated in FIG. 2, the interior of the pan is filled with a cement mix 20. The basic construction of pan 10 is more fully described in commonly owned U.S. Pat. No. 4,606,156. To the extent necessary, the disclosure of such patent is hereby incorporated by reference.

In accordance with the present invention, the pan is modified to include a peripheral flange arrangement which defines a downwardly opening channel. As seen in FIG. 2, sides 16 of the pan extend generally vertically from and are joined to bottom 14. Extending outwardly and horizontally from an upper edge 22 of each sidewall 16 is a generally L-shaped peripheral flange 24. Flange 24 includes a horizontally extending portion 26 and a downwardly extending portion 28. Flange 24 in conjunction with sidewall 16 defines a downwardly opening channel 30.

Figure 3:
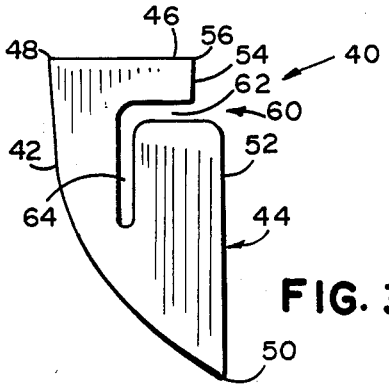
FIG. 3 is an end, elevational view of a peripheral trim piece in accordance with the present invention.

A peripheral trim piece 40 is mechanically locked on each flange 24. As seen in FIGS. 2 and 3, trim piece 40 is an elongated member or body. Piece 40 includes an outer curved surface 42, an inner surface 44 and a top surface 46. Surface 42 extends from an outer edge 48 of surface 46 downwardly until it joins a lower edge 50 of inner surface 44. As seen in FIGS. 2 and 3, surface 44 is stepped in side elevation and includes a lower portion 52 and an inwardly spaced upper portion 54. Portion 54 is joined to upper surface 46 at edge 56.

A generally L-shaped slot 60 opens through inner surface 44 and separates portions 52 and 54 of surface 44. Slot 60 includes a first portion or leg 62 which extends in spaced, parallel relationship to upper surface 46. Slot 60 further includes a second portion or leg 64 which extends downwardly and perpendicular to upper surface 46. As seen in FIG. 3, slot or groove 60 opens through the ends of trim piece 40. It is presently preferred that trim piece 40 be extruded as an elongated, continuous member from a vinyl material. It is preferred that the vinyl material be of the type which will not support combustion. When so formed, the trim may be provided on reels and cut to fit each side of the particular panel.

As seen in FIG. 2, trim 40 is dimensioned so that the body portion between outer surface 44 and slot portion 64 is snugly received within downwardly opening channel 30 defined by the pan. Flange portions 26, 28 are snugly received within slot 60. The inverted U-shaped configuration in cross section provides a snug, frictional and mechanical lock between the trim and the pan. A trim piece is assembled onto an edge of the pan by aligning the slot with the flange and then pushing or pulling the trim piece along the edge of the pan. The trim piece is relatively easily assembled and the piece is field replaceable. The configuration of the trim piece and panel adapts the assembly to automation.

Figure 4:
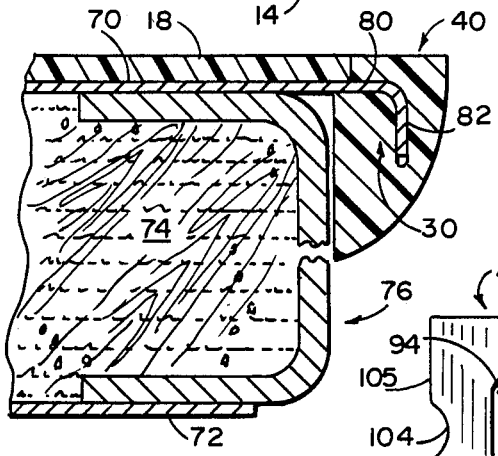
FIG. 4 is a fragmentary, side elevational view of an alternative embodiment of the present invention.

An alternative embodiment in accordance with the present invention is illustrated in FIG. 4. In the FIG. 4 embodiment, the rectangular pan includes a top galvanized steel sheet 70 and a bottom galvanized steel sheet 72. Sheets 70, 72 are bonded to a wood or high density particle core 74. The sheets 70, 72 are also welded to perimeter channels 76. The perimeter channels are therefore joined to the pan bottom and define the sidewalls of the pan. A panel finish or cover such as a high pressure plastic laminate 18 is bonded to the top sheet 70.

In the panel construction as illustrated in FIG. 4, a downwardly opening channel or groove 30 is defined by an extension or outer edge portion of top sheet 70. Sheet 70 includes an outer portion or flange 80 which extends beyond the sidewalls of the pan. Portion 80 includes a downwardly extending leg or flange 82. The downwardly turned peripheral edge of sheet 70 therefore defines downwardly opening channel 30. The peripheral trim piece 40 in accordance with the present invention is readily assembled onto edge portion 80 of panel 70 by sliding such portions into the slot 60 thereof.

Figure 5:
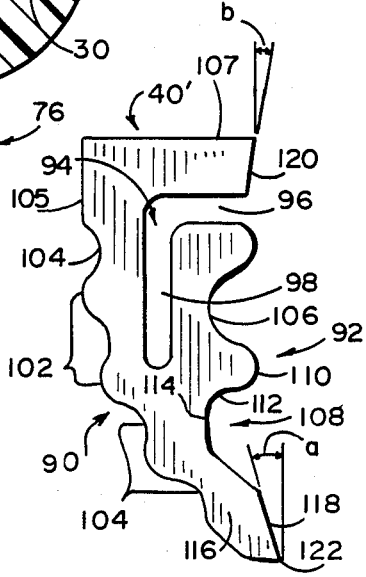
FIG. 5 is a side elevational view of an alternative embodiment of a trim piece in accordance with the present invention.

An alternative trim piece is illustrated in FIG. 5 and designated by the numeral 40'. Piece 40' is similar to piece 40 in that it includes an outer surface 90 joined to an inner surface 92. Piece 40' defines an L-shaped slot 94 also having portions 96, 98 identical to portions 62, 64 of piece 40. Outer surface 90 has a wavy, undulating transverse cross section defining peaks 102 joined to valleys 104. Surface 90 also includes a planar portion 105 joined to the planar top surface 107. Inner surface 92 includes longitudinal grooves 106, 108 separated by a ridge 110. Groove 106 is generally semicircular in transverse cross section. Groove 108 includes a sidewall 112 generally perpendicular to a base 114 and a curved sidewall 116 joined to an angled, flat portion 118. Portion 118 assumes an angle "a" of approximately 20° from vertical. An upper portion 120 of inner surface 92 is inset from lower edge 122 of portion 118. Portion 120 assumes an angle "b" of approximately 5° from vertical. The valleys and grooves reduce the amount of vinyl used in forming piece 40' when compared to piece 40. The material savings reduce the cost of the trim piece. The material is removed from areas of the pieces which do not have an effect on the appearance of the access floor panel when installed.

Figure 6:
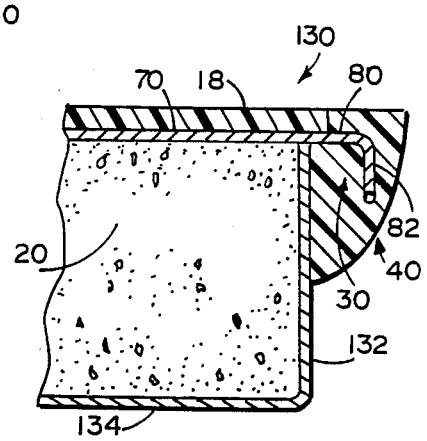
FIG. 6 is a fragmentary, side elevational view of a further alternative embodiment.

Another embodiment of the present invention is shown in FIG. 6. A panel 130 includes top plate or sheet 70 defining an edge portion 80 and a flange 82. The pan includes integral sidewalls 132 joined to a bottom 134. Sidewalls 132 in combination with top sheet 70 define the channel 30 which receives piece 40.

In view of the foregoing description, one of ordinary skill in the art will undoubtedly envision various modifications which will not depart from the inventive concepts disclosed herein. For example, the trim piece has been illustrated as being used with three types of pan and floor panel structures. In one, the pan defines the peripheral flange and includes sidewalls integral with a bottom. In another, a top sheet defines the flange and the sidewalls are formed by separate members joined to a bottom plate. In still another, a top plate or sheet cooperates with sidewalls integral with a bottom of a pan to define the necessary channel and flange. These are examples of the general configurations of pans used. Other panels or pans could, of course, be modified to cooperate with the trim piece. Modification would involve inclusion of a flange to define a channel with the pan sidewalls. Therefore, the above description should be considered as only that of the preferred embodiments. The true spirit and scope of the present invention may be determined by reference to the appended claims.

The embodiments of the invention in which an exclusive property or privilege is claimed are defined as follows:

1. An access floor panel, comprising:

a generally rectangular pan having a bottom and sides, said pan including a peripheral flange which along with said sides defines a downwardly opening channel extending around the periphery thereof; and a plurality of elongated trim pieces disposed within said channel, each of said trim pieces including a generally L-shaped slot dimensioned to receive said flange, said sides being integral with said bottom of said pan, said sides extending generally vertically from said bottom and wherein said peripheral flange includes a horizontally extending portion joined to said sides and a downwardly extending portion, each of said trim pieces being an integral one-piece member having an outer surface, an inner surface and a top surface, said L-shaped slot opening through said inner surface and including a first portion extending in spaced parallel relationship to said top surface and a second portion extending perpendicular to said top surface, and wherein said outer surface of said trim piece curves inwardly and joins a lower edge of said inner surface.

2. An access floor panel as defined by claim 1 wherein said outer surface has an undulating transverse cross section and said inner surface defines two longitudinal grooves separated by a ridge.

3. An access floor panel, comprising:

a generally rectangular pan having a bottom and sides, said pan including a peripheral flange which along with said sides defines a downwardly opening channel extending around the periphery thereof; and a plurality of elongated trim pieces disposed within said channel, each of said trim pieces including a generally L-shaped slot dimensioned to receive said flange, said pan further including a top plate, said top plate including peripheral edge portions extending beyond said sides and turned downwardly to form said peripheral flange, and wherein said pan includes channel members joined to said bottom, said channel members defining said sides.

4. An access floor panel as defined by claim 3 wherein each of said trim pieces is an integral one-piece member having an outer surface, an inner surface and a top surface, said L-shaped slot opening through said inner surface and including a first portion extending in spaced parallel relationship to said top surface and a second portion extending perpendicular to said top surface.

5. An access floor panel as defined by claim 4 wherein said outer surface of said trim piece curves smoothly inwardly and joins a lower edge of said inner surface.

6. An access floor panel, comprising:

a generally rectangular pan having a bottom and sides, said pan including a peripheral flange which along with said sides defines a downwardly opening channel extending around the periphery thereof; and a plurality of elongated trim pieces disposed within said channel, each of said trim pieces including a generally L-shaped slot dimensioned to receive said flange, each of said trim pieces being an integral one-piece member having an outer surface, an inner surface and a top surface, said L-shaped slot opening through said inner surface and including a first portion extending in spaced parallel relationship to said top surface and a second portion extending perpendicular to said top surface, and wherein said outer surface has an undulating transverse cross section and said inner surface defines two longitudinal grooves separated by a ridge.

7. An access floor panel, comprising:

a generally rectangular pan having a bottom and sides, said pan including a peripheral flange which along with said sides defines a downwardly opening channel extending around the periphery thereof; and a plurality of elongated trim pieces disposed within said channel, each of said trim pieces including a generally L-shaped slot dimensioned to receive said flange, each of said trim pieces being an integral one-piece member having an outer surface, an inner surface and a top surface, said L-shaped slot opening through said inner surface and including a first portion extending in spaced parallel relationship to said top surface and a second portion extending perpendicular to said top surface, and wherein said outer surface of said trim piece curves smoothly inwardly and joins a lower edge of said inner surface.

8. A trim piece adapted to be slid onto an elongated, generally L-shaped flange defined by an access floor panel, said trim piece comprising:

an elongated, extruded body having ends, an outer, generally curved surface, a generally flat, vertically extending inner surface having a lower edge joined to said outer surface and a horizontally extending top surface having an edge joined to said outer surface, said body defining a generally L-shaped, elongated slot opening through said ends and said inner surface of said body, said slot dimensioned to receive said L-shaped flange of the access floor panel, and wherein said inner surface is stepped and includes a lower portion and a parallel, inwardly spaced upper portion separated by said slot.

9. A trim piece adapted to be slid onto an elongated, generally L-shaped flange defined by an access floor panel, said trim piece comprising:

an elongated, extruded body having ends, an outer, generally curved surface, a generally vertically extending inner surface having a lower edge joined to said outer surface and a horizontally extending top surface having an edge joined to said outer surface, said body defining a generally L-shaped, elongated slot opening through said ends and said inner surface of said body, said slot dimensioned to receive said L-shaped flange of the access floor panel, and wherein said outer, generally curved surface defines a planar portion and a portion having an undulating transverse cross section.

10. A trim piece as defined by claim 9 wherein said inner surface defines a pair of spaced, parallel, longitudinally extending grooves separated by a ridge, one of said grooves being joined to an angled planar portion.

* * * * *